US007286033B2

(12) United States Patent
Ozaki et al.

(10) Patent No.: US 7,286,033 B2
(45) Date of Patent: Oct. 23, 2007

(54) FERRO-MAGNETIC FORCE FIELD GENERATOR

(75) Inventors: Osamu Ozaki, Tsukuba (JP); Tsukasa Kiyoshi, Tsuchiura (JP); Shinji Matsumoto, Tsukuba (JP); Hitoshi Wada, Tsukuba (JP)

(73) Assignees: Japan Science and Technology Corporation, Kawaguchi-shi (JP); National Institute for Materials Science, Tsukuba-shi (JP)

( * ) Notice: Subject to any disclaimer, the term of this patent is extended or adjusted under 35 U.S.C. 154(b) by 482 days.

(21) Appl. No.: 10/362,213

(22) PCT Filed: Jun. 12, 2002

(86) PCT No.: PCT/JP02/05834

§ 371 (c)(1),
(2), (4) Date: Feb. 12, 2004

(87) PCT Pub. No.: WO03/001542

PCT Pub. Date: Jan. 3, 2003

(65) Prior Publication Data

US 2004/0119568 A1 Jun. 24, 2004

(30) Foreign Application Priority Data

Jun. 26, 2001 (JP) ..... 2001-192419

(51) Int. Cl.
*H01F 7/00* (2006.01)

(52) U.S. Cl. ..... 335/296; 335/299

(58) Field of Classification Search ..... 335/216, 335/296–299

See application file for complete search history.

(56) References Cited

U.S. PATENT DOCUMENTS

| | | | | | |
|---|---|---|---|---|---|
| 5,373,275 | A | * | 12/1994 | Itoh et al. | 335/216 |
| 5,640,887 | A | * | 6/1997 | Hull et al. | 74/572.11 |
| 6,020,803 | A | * | 2/2000 | Wheatley et al. | 335/216 |
| RE36,782 | E | * | 7/2000 | Brown et al. | 335/216 |

FOREIGN PATENT DOCUMENTS

| | | |
|---|---|---|
| JP | 1998-172825 | 6/1998 |
| JP | 11-329835 | 11/1999 |
| JP | 2000-77225 | 3/2000 |

* cited by examiner

*Primary Examiner*—Elvin Enad
*Assistant Examiner*—Bernard Rojas
(74) *Attorney, Agent, or Firm*—Oblon, Spivak, McClelland, Maier & Neustadt, P.C.

(57) ABSTRACT

A strong-magnetic-force field generating device is provided which can increase a magnetic force field and which can make the magnetic force field spatially uniform without adding an additional superconducting magnet to a commercially-available superconducting magnet. In the strong-magnetic-force field generating device, a disc ferromagnetic element is arranged inside a bore and above the equatorial plane thereof in a solenoid superconducting magnet, whose central axis is directed in a vertical direction, so as to be symmetric with respect to the central axis; and a ring ferromagnetic element is arranged above the disc ferromagnetic element so as to be out of contact with the disc ferromagnetic element and so as to be symmetric with respect to the central axis.

3 Claims, 10 Drawing Sheets

(a)

(b)

FERRO-MAGNETIC FORCE FIELD GENERATOR

TECHNICAL FIELD

The present invention relates to a strong-magnetic-force field generating device.

BACKGROUND ART

An X-ray diffraction analysis is available as a method for analyzing the structure of a protein molecule. A protein needs to be crystallized for the X-ray diffraction analysis, and the quality of the crystal is one important factor that governs the analysis accuracy.

Recently, it has been reported that the convection of a protein water solution can be suppressed in a microgravity environment and the quality of the protein crystal therefrom is superior than one produced in a gravity of 1 G (N. I. Wakayama, Mitsuo Ataka, Haruo Abe, "Effect of a magnetic field gradient on the crystallization of hen lysozyme," Journal of Crystal Growth, 178 pp, 653–656, 1997).

As a method for achieving a microgravity environment for a few days, there is a method in which a sample is launched into a satellite's orbit or a method in which magnetic force is applied to a protein water solution such that the gravity is cancelled out since a protein, water, and the like are diamagnetic materials. The former method, however, has problems in that the cost is high and the opportunity is quite limited, and thus expectations are directed to the latter method in which magnetic force is utilized. Needless to say, diamagnetic material means material that is magnetized in a direction opposite to an external magnetic field H.

The present invention is directed to a device for achieving a microgravity environment by using magnetic force on Earth. The present invention is mainly applied to protein crystal growth, but not limited thereto. Thus, it can also be applied to refinement or the like of crystals other than alloys, medicine, protein, and the like utilizing a microgravity environment.

In order to virtually put a protein water solution or the like into a microgravity condition on Earth using magnetic force, there is a need for a large-absolute value and spatially-uniform magnetic force field (the product of a magnetic field and a gradient magnetic field is defined as a magnetic force field, and will hereinafter represented as a magnetic force field). At present, a large hybrid magnet that uses a superconducting magnet at the outer part and a water-cooled copper magnet at the inner part is employed as means for accomplishing a large-absolute-value magnetic force field.

Such a large hybrid magnet, however, has a magnet that is gigantic itself and also power required for the operation is as high as several mega watts. Thus, the cost for manufacturing and operating such a device becomes high.

As means for solving the problems, there are some available methods. In one method, a large magnetic force field is obtained by setting superconducting coils in a bore of a commercially-available superconducting magnet, one superconducting coil being used for generating a magnetic field in the same direction as the superconducting magnet and the other being used for generating a magnetic field in a direction opposite thereto. In another method, a ferromagnetic ring or disc is further set thereto to obtain a large magnetic force field (see Japanese Unexamined Patent Application Publication No. 2000-77225, for example).

DISCLOSURE OF INVENTION

In the above-described related art, however, an additional superconducting magnet needs to be set in a bore of a commercially-available superconducting magnet to generate a large magnetic force field. In this case, since the superconducting magnet needs to be cooled down to an absolute temperature of about 4 K, the structure of the device becomes complicated, thereby increasing the manufacturing cost.

Also, although the magnetic force field is increased by setting a ferromagnetic ring or disc alone in a bore of a superconducting magnet, a spatially-uniform magnetic force field cannot be obtained in such a case.

A problem when the ferromagnetic ring or disc alone is set in a bore of a magnet will be described below in detail.

FIG. 1 is a configuration view of a case in which a conventional disc ferromagnetic element alone is set in a bore of a superconducting magnet.

In this figure, reference numeral 101 indicates a superconducting magnet, 102 is a winding frame for the superconducting magnet, and 103 is a disc ferromagnetic element placed in the bore of the superconducting magnet.

FIG. 2 is a distribution plot of the magnetic force field of the strong-magnetic-force field generating device shown in FIG. 1.

In this figure, the horizontal axis represents an axial direction position, the vertical axis represents a magnetic force field ($T^2/m$), the halftone dot area represents a sample space, and the curve a represents a magnetic force field with respect to the axial direction position when the superconducting magnet and the disc ferromagnetic element are set.

FIG. 3 is a configuration view of a case in which a conventional ring ferromagnetic element alone is set in a bore of a superconducting magnet.

In this figure, reference numeral 111 indicates a superconducting magnet, 112 is a winding frame for the superconducting magnet, and 113 is a ring ferromagnetic element placed in the bore of the superconducting magnet.

FIG. 4 is a distribution plot of the magnetic force field of the strong-magnetic-force field generating device shown in FIG. 3.

In this figure, the horizontal axis represents an axial direction position, the vertical axis represents a magnetic force field ($T^2/m$), the halftone dot area represents a sample space, and the curve b represents a magnetic force field with respect to the axial direction position when the superconducting magnet and the ring ferromagnetic element are set.

As shown in FIGS. 1 and 3, when the disc ferromagnetic element 103 or the ring ferromagnetic element 113 is arranged inside the bore of the commercially-available superconducting magnet 101 or 111 that generates a magnetic field having a central magnetic field of 2 T or more, the magnetization of the ferromagnetic element is saturated and the direction of the magnetization thereof becomes parallel to the direction of magnetic field of the superconducting magnet 101 or 111. For example, with pure iron, the saturation magnetization thereof is 2.2 T. In the vicinity of such a ferromagnetic element, the magnetic-field gradient becomes large, thereby increasing the magnetic force field (the product of the magnetic field and the gradient magnetic field). However, when only the disc ferromagnetic element 103 is arranged, as shown in FIG. 1, above the equatorial plane of the bore in the superconducting magnet 101, the magnetic force field in the axial direction is distributed as shown in FIG. 2 and is not distributed spatially uniform.

Also, when only the ring ferromagnetic element 113 is arranged, as shown in FIG. 3, above the equatorial plane of the bore in the superconducting magnet 111, the magnetic force field in the axial direction is distributed as shown in FIG. 4 and is not distributed spatially uniform.

It is an object of the present invention to provide a strong-magnetic-force field generating device that can increase the magnetic force field and that can make the magnetic force field spatially-uniform without adding an additional superconducting magnet to a commercially-available superconducting magnet.

To achieve the above object, the present invention provides the followings.

[1] In a strong-magnetic-force field generating device, a disc ferromagnetic element is arranged inside a bore and above the equatorial plane thereof in a solenoid superconducting magnet, whose central axis is directed in a vertical direction, so as to be symmetric with respect to the central axis; and a ring ferromagnetic element is arranged above the disc ferromagnetic element so as to be out of contact with the disc ferromagnetic element and so as to be symmetric with respect to the central axis.

[2] In a strong-magnetic-force field generating device, a disc ferromagnetic element is arranged inside a bore and above the equatorial plane thereof in coaxially-arranged solenoid superconducting magnets, whose axes are directed in a vertical direction, so as to be symmetric with respect to the central axis; and a corresponding ring ferromagnetic element is arranged above the disc ferromagnetic element so as to be out of contact with the disc ferromagnetic element and so as to be symmetric with respect to the central axis.

[3] In the strong-magnetic-force field generating device recited in [2] described above, ferromagnetic elements of the same shape are arranged at a position symmetric with respect to the equatorial plane.

BEST MODE FOR CARRYING OUT THE INVENTION

The embodiments of the present invention will now be described in detail.

Figure 1:
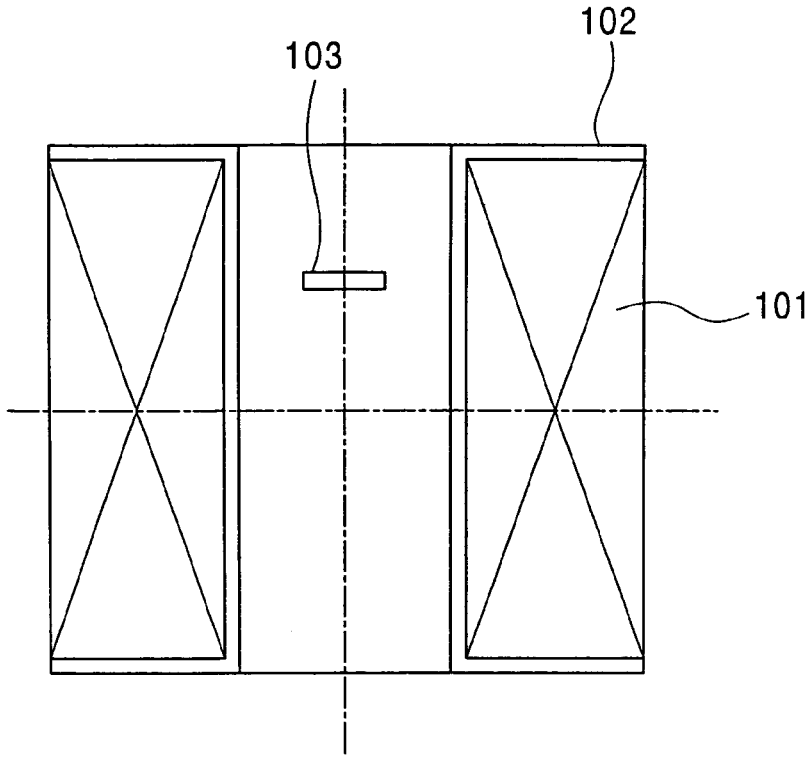
FIG. 1 is a configuration view of a case in which a conventional disc ferromagnetic element alone is set in a bore of a superconducting magnet.
Figure 2:
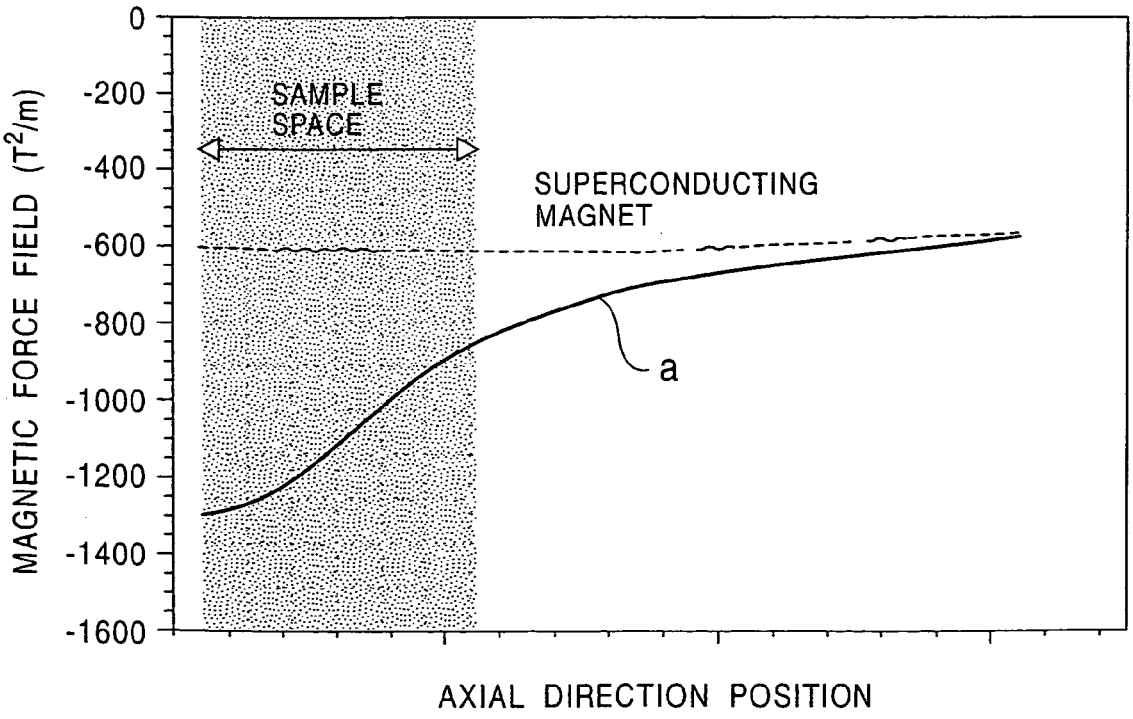
FIG. 2 is a distribution plot of the magnetic force field of the strong-magnetic-force field generating device shown in FIG. 1.
Figure 3:
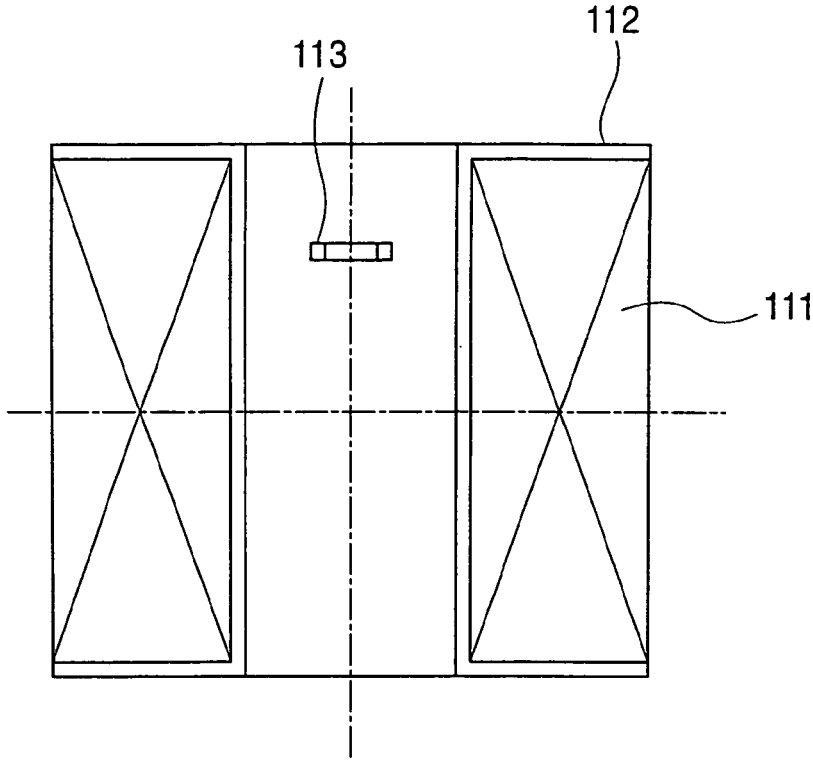
FIG. 3 is a configuration view of a case in which a conventional ring ferromagnetic element alone is set in a bore of a superconducting magnet.
Figure 4:
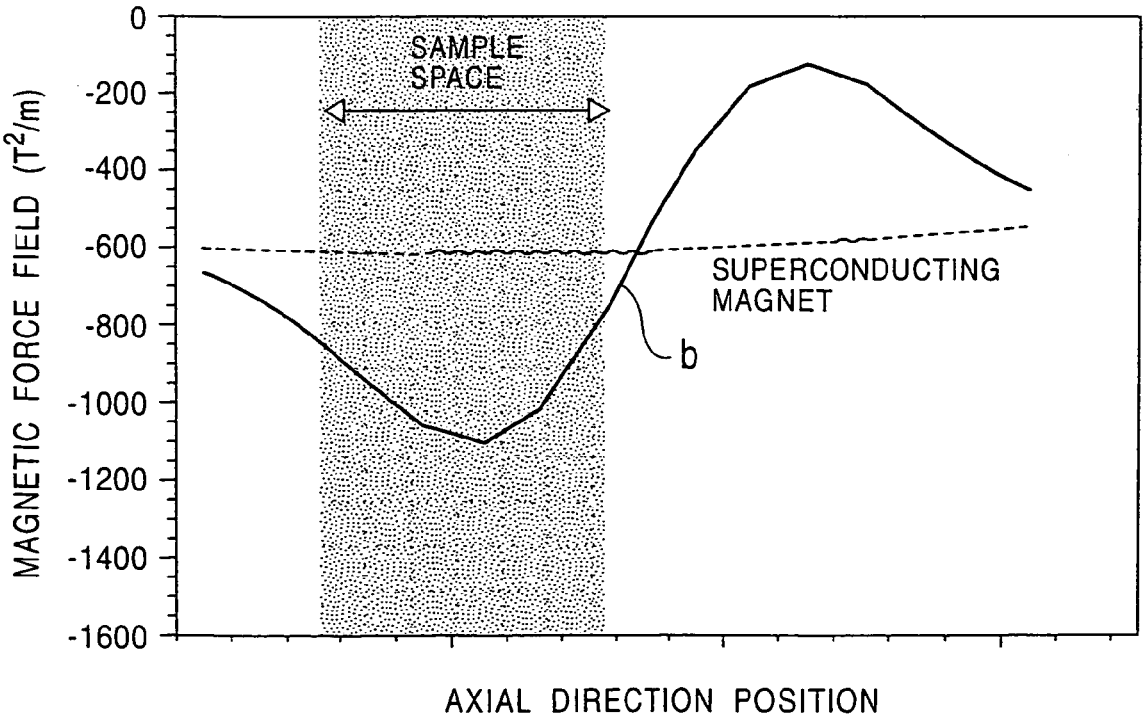
FIG. 4 is a distribution plot of the magnetic force field of the strong-magnetic-force field generating device shown in FIG. 3.
Figure 5:
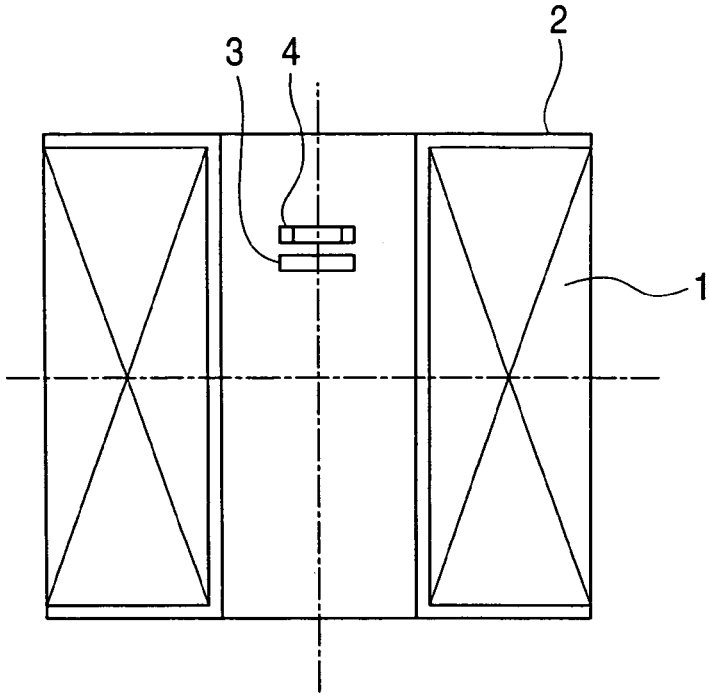
FIG. 5 is a configuration view of a strong-magnetic-force field generating device to illustrate the principle of the present invention.
Figure 5:
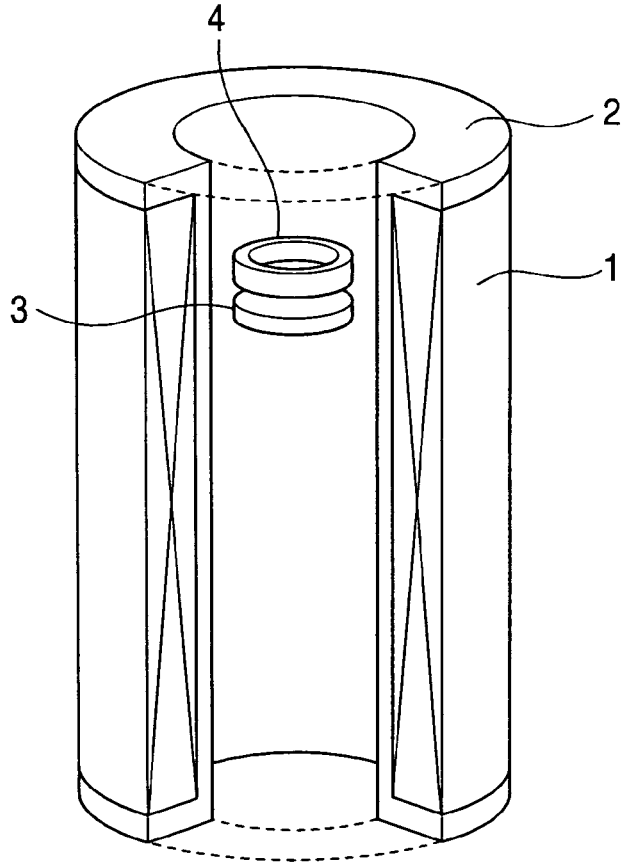

FIG. 5 is a configuration view of a strong-magnetic-force field generating device to illustrate the principle of the present invention, FIG. 5(*a*) being a sectional view of the strong-magnetic-force field generating device and FIG. 5(*b*) being a partially cutaway perspective view of the strong-magnetic-force field generating device.

In these figures, reference numeral 1 indicates a superconducting magnet, 2 is a winding frame for the superconducting magnet, 3 is a disc ferromagnetic element arranged in a bore of the superconducting magnet 1, and 4 is a ring ferromagnetic element arranged in the bore of the superconducting magnet 1.

As shown in the figures, the disc ferromagnetic element 3 is arranged above the equatorial plane of the bore of the superconducting magnet 1, and the ring ferromagnetic element 4 is further arranged above the disc ferromagnetic element 3 such that the ferromagnetic elements 3 and 4 are coaxial and are out of contact with each other. With this arrangement, the gradient magnetic fields of the ring ferromagnetic element 4 and the disc ferromagnetic element 3 are added together, so that the magnetic force field between the ring ferromagnetic element 4 and the disc ferromagnetic element 3 is increased and a space where the intensity of the magnetic force field in the sample space is uniform can be provided.

Figure 6:
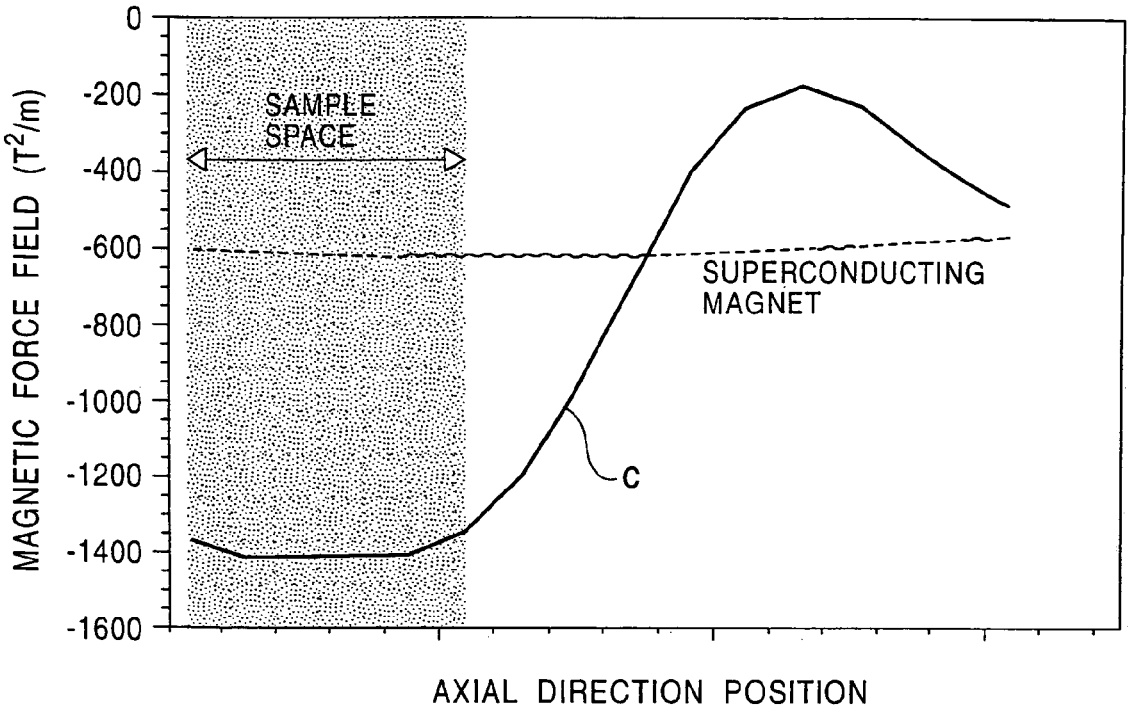
FIG. 6 is a graph showing distribution in the axial direction of the magnetic force field in FIG. 5.

FIG. 6 is a graph showing distribution of the magnetic force field in the axial direction in that case.

In this figure, the horizontal axis represents an axial direction position, the vertical axis represents a magnetic force field ($T^2/m$), the halftone dot area represents a sample space, and the curve c represents a magnetic force field with respect to the axial direction position when the superconducting magnet, the disc ferromagnetic element, and the ring ferromagnetic element are set.

As is apparent from the figure, in the above sample space, the magnetic force field that can be generated by the commercially-available superconducting magnet 1 can be increased and also be made spatially uniform without using an additional superconducting magnet as in a conventional manner.

Figure 7:
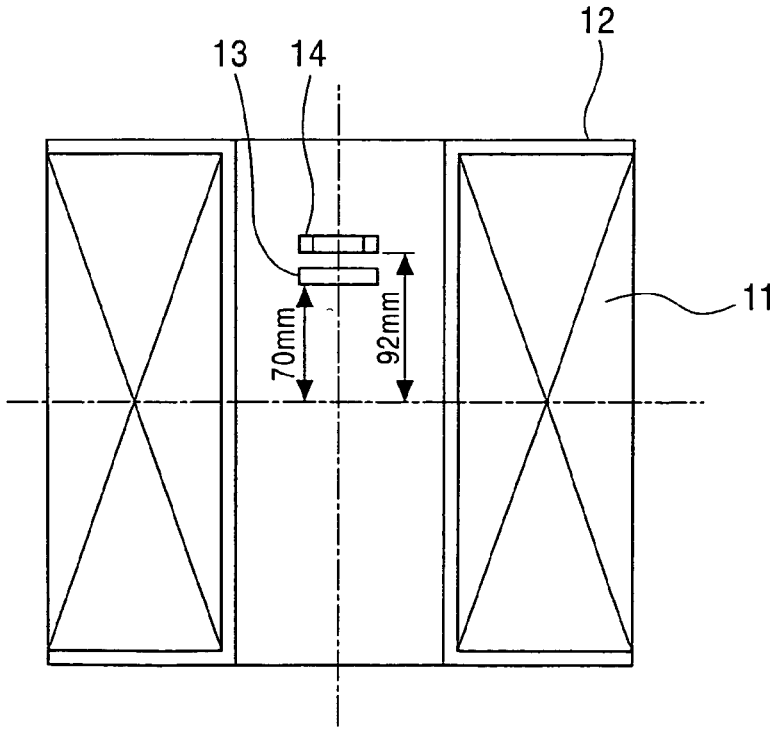
FIG. 7 is a configuration view of a strong-magnetic-force field generating device to illustrate a first embodiment of the present invention.

FIG. 7 is a configuration view of a strong-magnetic-force field generating device to illustrate a first embodiment of the present invention.

In this figure, reference numeral 11 indicates a superconducting magnet, 12 is a winding frame for the superconducting magnet, 13 is a disc ferromagnetic element arranged in a bore of the superconducting magnet 11, and 14 is a ring ferromagnetic element arranged in the bore of the superconducting magnet 11. In this case, the disc ferromagnetic element 13 is positioned at a height of 70 mm from the center of the superconducting magnet, and the ring ferromagnetic element 14 is positioned at a height of 92 mm from the center of the superconducting magnet.

The commercially-available superconducting magnet 11 having the specification shown in Table 1 is used, and the disc ferromagnetic element 13 and the ring ferromagnetic element 14, which are made of pure iron, are arranged above the equatorial plane of the bore of the superconducting magnet 11, as shown in FIG. 7.

| | |
|---|---|
| Inner Diameter of Winding (mm) | 120 |
| Outer Diameter of Winding (mm) | 300 |
| Length of Winding (mm) | 220 |
| Number of Turns | 19800 |
| Current (A) | 145.8 |
| Center magnetic field (T) | 12.0 |

Table 2 shows the geometric configurations of the disc ferromagnetic element 13 and the ring ferromagnetic element 14, which are made of pure iron.

TABLE 2

| | Disc Ferromagnetic Element | Ring Ferromagnetic Element |
|---|---|---|
| Inner Diameter (mm) | — | 20 |
| Outer Diameter (mm) | 22 | 40 |
| Thickness (mm) | 10 | 10 |

The disc ferromagnetic element 13 and the ring ferromagnetic element 14, which are made of pure iron, are magnetized in the direction in which the magnetic field of the superconducting magnet is generated, and the magnetization thereof is saturated to 2.2 T.

Figure 8:
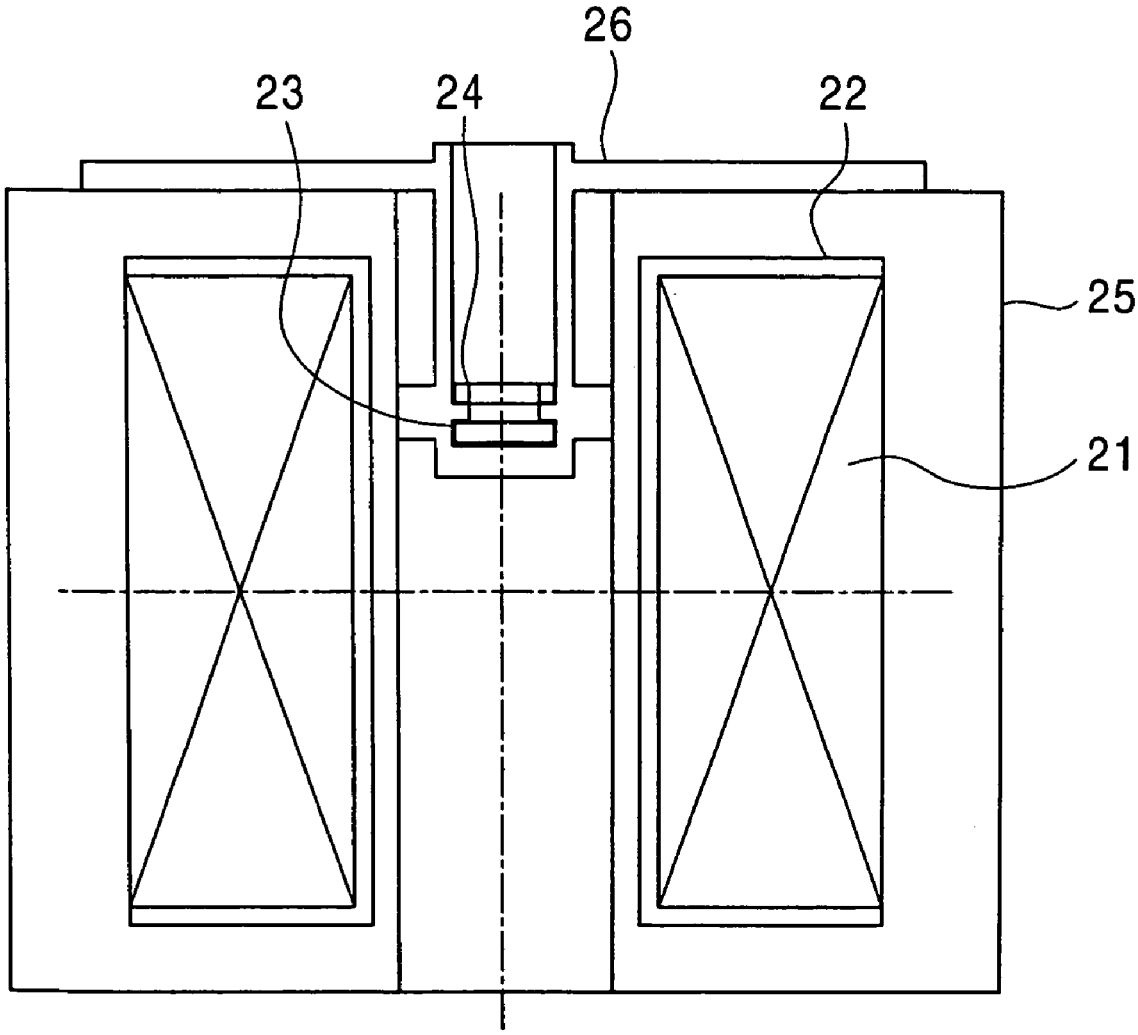
FIG. 8 is a configuration view of a strong-magnetic-force field generating device to illustrate a specific example of the first embodiment of the present invention.

FIG. 8 is a configuration view of a strong-magnetic-force field generating device to illustrate a specific example of the first embodiment of the present invention.

In this figure, reference numeral 21 indicates a superconducting magnet, 22 is a winding frame for the superconducting magnet, 23 is a disc ferromagnetic element, 24 is a ring ferromagnetic element, 25 is a cryostat for the superconducting magnet 21, and 26 is a support. The support 26 is made of non-magnetic material and is used for fixing the disc ferromagnetic element 23 and the ring ferromagnetic element 24 to the cryogenic container 25.

As shown in the figure, the support 26, which is made of non-magnetic material, securely fixes the disc ferromagnetic element 23 and the ring ferromagnetic element 24, which are made of pure iron, in the bore of the superconducting magnet 21, since magnetic force acts on the disc ferromagnetic element 23 and the ring ferromagnetic element 24.

Figure 9:
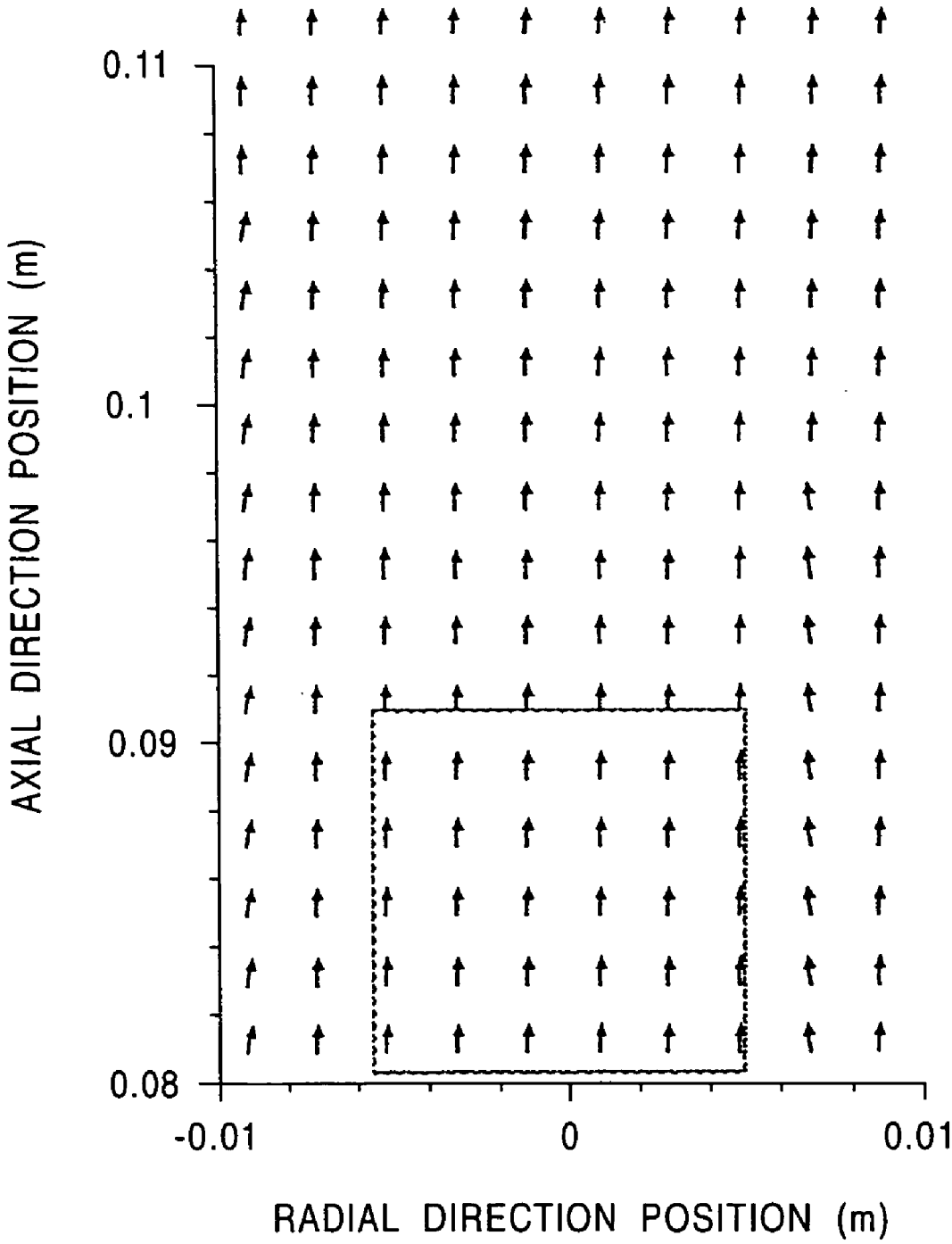
FIG. 9 is a vector diagram of magnetic force acting on a diamagnetic element in the absence of the disc ferromagnetic element and the ring ferromagnetic element.
Figure 10:
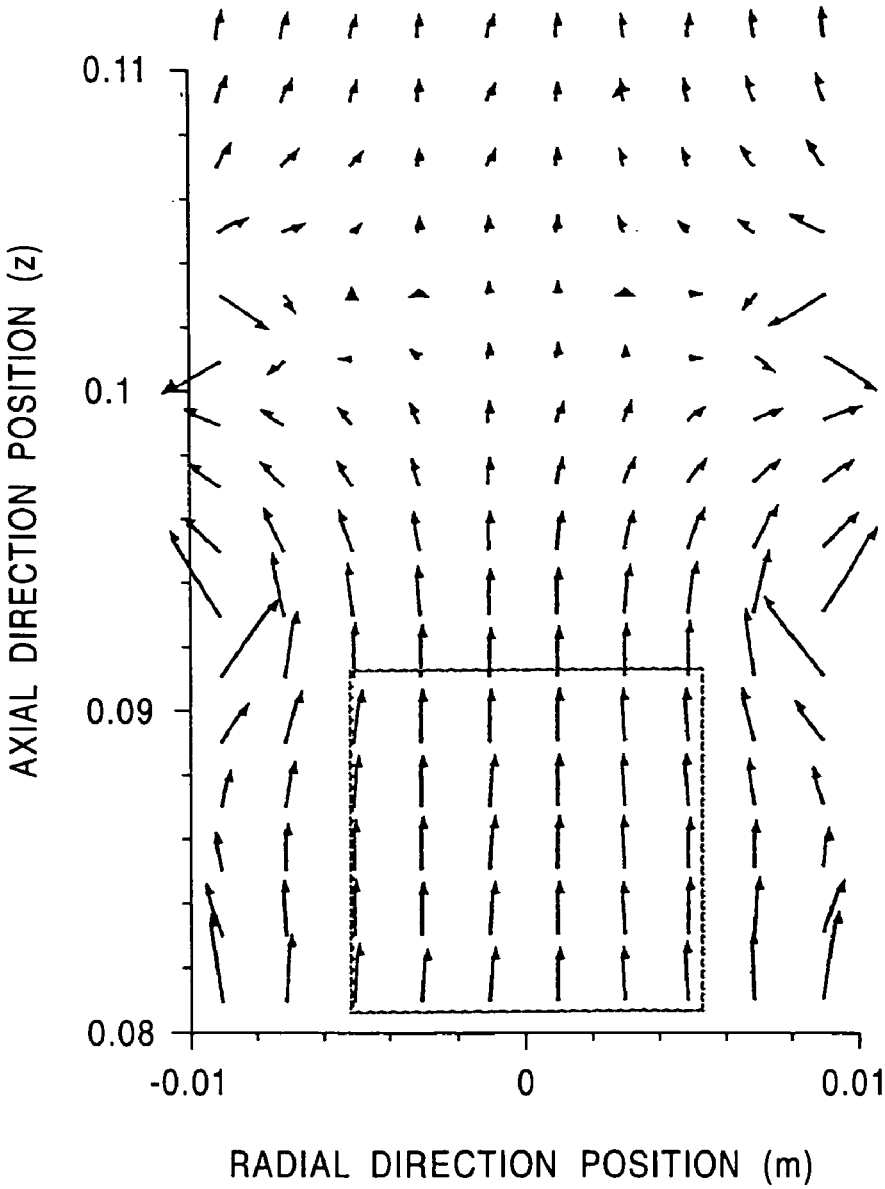
FIG. 10 is a vector diagram of magnetic force acting on the diamagnetic element in the presence of the disc ferromagnetic element and the ring ferromagnetic element.

FIG. 9 is a vector diagram of magnetic force acting on a diamagnetic element in the absence of the disc ferromagnetic element and the ring ferromagnetic element, and FIG. 10 is a vector diagram of magnetic force acting on the diamagnetic element in the presence of the disc ferromagnetic element and the ring ferromagnetic element.

In FIGS. 9 and 10, the horizontal axis represents a radial direction position (m), the vertical axis represents an axial direction position (m), and the framed area represents a cylindrical sample space of 10 mm in diameter and 10 mm in length.

As can be seen from the comparison of FIGS. 9 and 10, the presence of the disc ferromagnetic element 23 and the ring ferromagnetic element 24, which are made of pure iron, increases the magnetic force field in the sample space of 10 mm in diameter and 10 mm in length.

Figure 11:
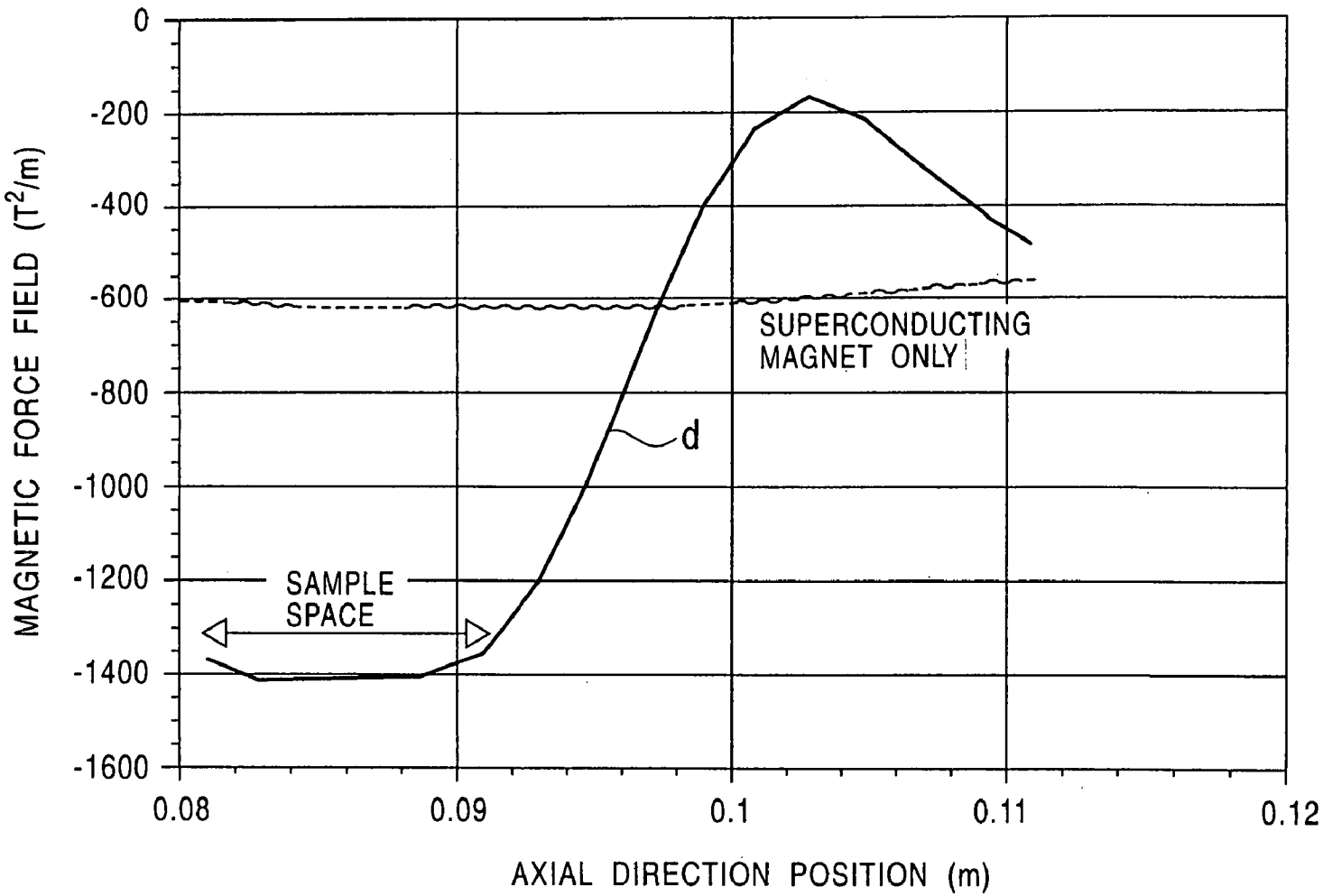
FIG. 11 is a graph showing distribution in the axial direction of the magnetic force field of the strong-field-force generating device according to the specific example of the first embodiment of the present invention.

FIG. 11 shows distribution in the axial direction of the magnetic force field.

In this figure, the horizontal axis represents an axial direction position (m), the vertical axis represents a magnetic force field ($T^2/m$), the range of 0.082 to 0.092 in the axial direction represents a sample space, and the curve d represents a magnetic force field with respect to the axial direction position when the superconducting magnet, the disc ferromagnetic element, and the ring ferromagnetic element are set.

As shown in the figure, the magnetic force field could be made spatially uniform, and additionally could be increased in value from 600 $T^2/m$ to 1420 $T^2/m$.

Figure 12:
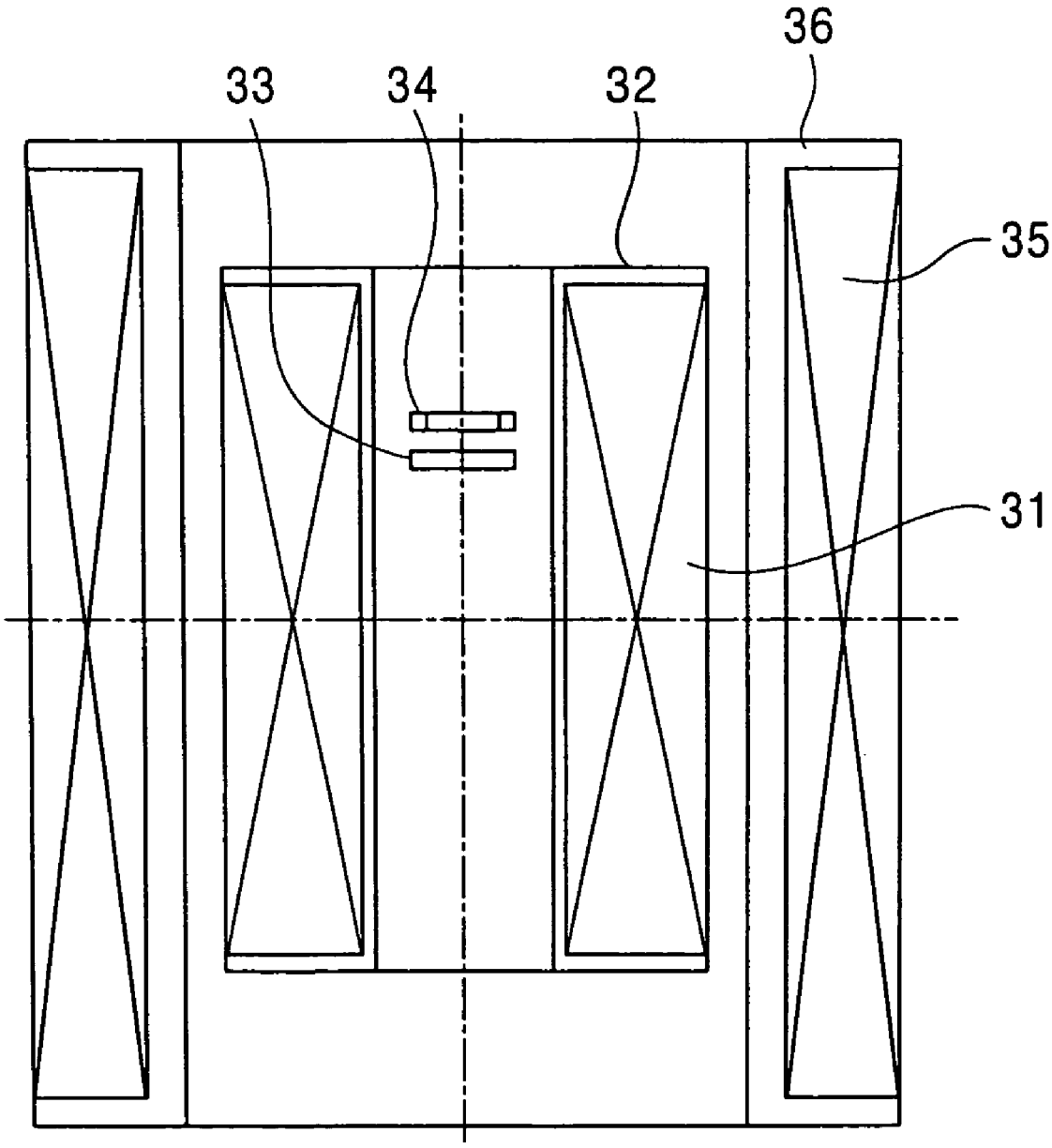
FIG. 12 is a configuration view of a strong-magnetic-force field generating device to illustrate a second embodiment of the present invention.

FIG. 12 is a configuration view of a strong-magnetic-force field generating device to illustrate a second embodiment of the present invention.

In this figure, reference numeral 31 indicates a first superconducting magnet 31, 32 is a winding frame for the first superconducting magnet 31, 33 is a disc ferromagnetic element, 34 is a ring ferromagnetic element, 35 is a second superconducting magnet coaxially arranged outside the first superconducting magnet 31, and 36 is a winding frame for the second superconducting magnet.

Since two superconducting magnets are used in such a manner, the present invention is also effective for a case of a superconducting magnet capable of generating a large magnetic field.

Figure 13:
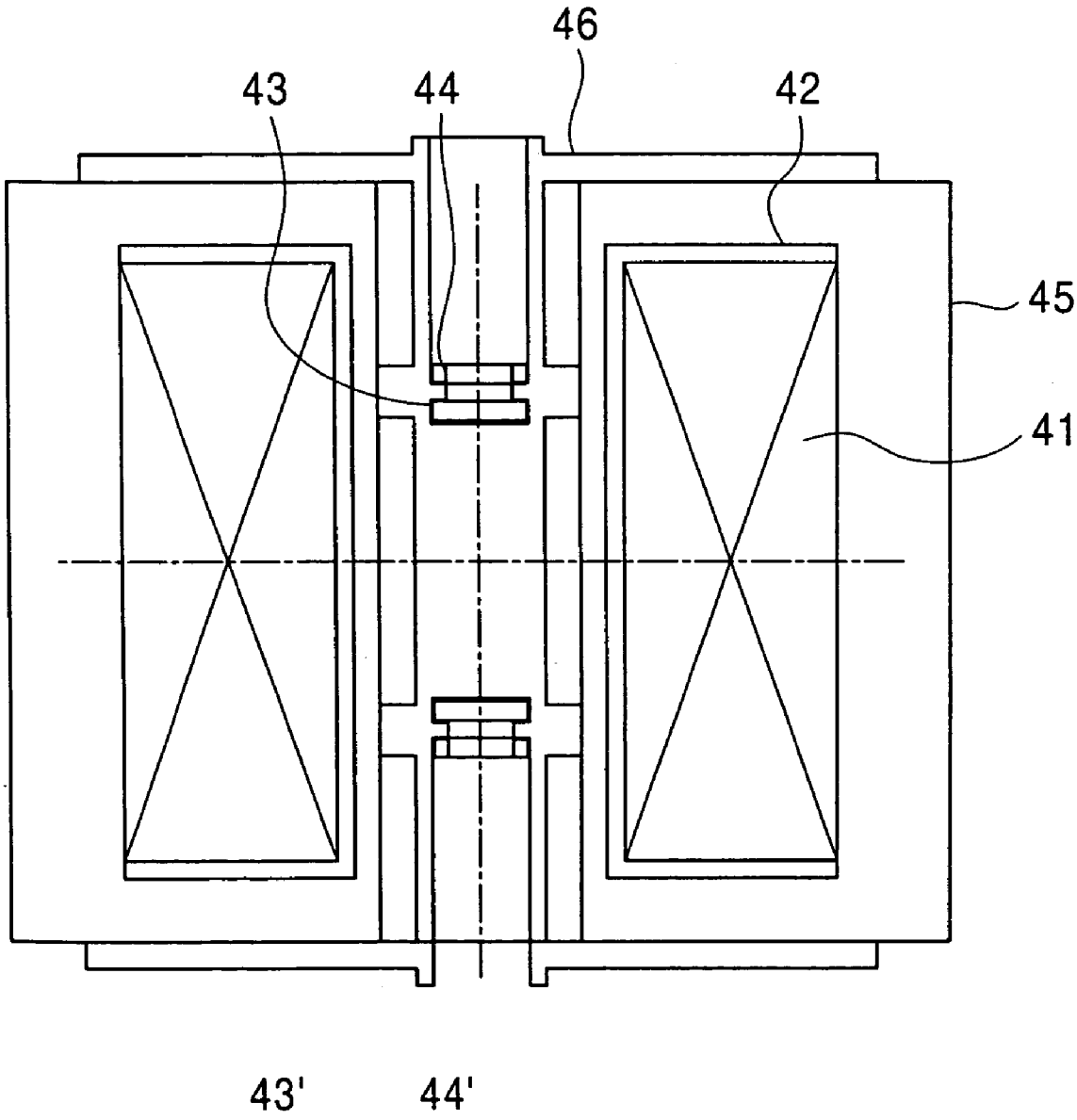
FIG. 13 is a configuration view of a strong-magnetic-force field generating device to illustrate a third embodiment of the present invention.

FIG. 13 is a configuration view of a strong-magnetic-force field generating device to illustrate a third embodiment of the present invention.

In this figure, reference numeral 41 indicates a superconducting magnet, 42 is a winding frame for the superconducting magnet 41, 43 and 43' are disc ferromagnetic elements, 44 and 44' are ring ferromagnetic elements, 45 is a cryostat for the superconducting magnet 41, and 46 is a support. The support 46 is made of non-magnetic material and is used for fixing the disc ferromagnetic element 43 and the ring ferromagnetic element 44 to the cryostat 45.

In this embodiment, the disc ferromagnetic element 43 and the ring ferromagnetic element 44, which are of the same material and shape as the first embodiment, are further arranged at an axi-symmetric position in the bore of the superconducting magnet 41. That is, two sets of the disc ferromagnetic elements 43 and 43' and the ring ferromagnetic elements 44 and 44' are set.

According to this approach, the sum of electromagnetic forces acting on the ferromagnetic elements and the superconducting magnet becomes zero, thereby canceling out an additional electromagnetic force resulting from the addition of the ferromagnetic elements to the superconducting magnet. Consequently, similarly to the first embodiment, this embodiment can increase the magnetic force field from 600 $T^2/m$ to 1420 $T^2/m$.

This embodiment is not necessarily limited to the use of a ferromagnetic material of the same material and shape as those of the first embodiment, and thus is not limited thereto as long as it is applied to a case in which ferromagnetic elements are arranged such that the sum of the electromagnetic forces of the ferromagnetic elements and a superconducting magnet becomes zero.

In addition, the present invention is not limited to the embodiments described above. Thus, various modifications are possible thereto in accordance with the spirit of the present invention, and such modifications are not excluded from the scope of the present invention.

As described above in detail, according to the present invention, it is possible to increase a magnetic force field while keeping the uniformity thereof, without adding an additional superconducting magnet to an internally-provided superconducting magnet.

Additionally, it is possible to achieve a reduction in the size and the manufacturing cost of a device in relation to the magnitude of a magnetic force field.

INDUSTRIAL APPLICABILITY

The strong-magnetic-forced field generating device of the present invention is preferably used as a device for protein crystal growth and is further expected to be applied to the manufacture of alloys, new medicine, and high-purity glass.

The invention claimed is:

1. A strong-magnetic-force field generating device, characterized in that a disc ferromagnetic element is arranged inside a bore and above the equatorial plane thereof in a solenoid superconducting magnet, whose central axis is directed in a vertical direction, so as to be symmetric with respect to the central axis; and a ring ferromagnetic element is arranged above the disc ferromagnetic element so as to be out of contact with the disc ferromagnetic element and so as to be symmetric with respect to the central axis.

2. A strong-magnetic-force field generating device, characterized in that a disc ferromagnetic element is arranged inside a bore and above the equatorial plane thereof in coaxially-arranged solenoid superconducting magnets, whose axes are directed in a vertical direction, so as to be symmetric with respect to the central axis; and a corresponding ring ferromagnetic element is arranged above the disc ferromagnetic element so as to be out of contact with the disc ferromagnetic element and so as to be symmetric with respect to the central axis.

3. A strong-magnetic-force field generating device according to the strong-magnetic-force field generating device as defined in claim 2, characterized in that ferromagnetic elements of the same shape are arranged at a position symmetric with respect to the equatorial plane.

* * * * *